US005607068A

United States Patent [19]

Coretti, Jr. et al.

[11] Patent Number: 5,607,068

[45] Date of Patent: Mar. 4, 1997

[54] GRAVITY FLOW SHELVING SYSTEM

[75] Inventors: Joseph Coretti, Jr.; Edward I. Knorring, Jr., both of Wheaton, Ill.

[73] Assignee: B-O-F Corporation, Aurora, Ill.

[21] Appl. No.: 382,084

[22] Filed: Feb. 1, 1995

[51] Int. Cl.[6] ..... A47F 7/00

[52] U.S. Cl. ..... 211/59.2

[58] Field of Search ..... 211/59.2, 151, 211/150, 184; 108/60, 61

[56] References Cited

U.S. PATENT DOCUMENTS

| | | | |
|---|---|---|---|
| 4,331,243 | 5/1982 | Doll . | |
| 5,115,920 | 5/1992 | Tipton et al. | 211/59.2 |
| 5,277,486 | 1/1994 | Bustos | 211/59.2 X |
| 5,487,474 | 1/1996 | Heimendinger | 211/59.2 |
| 5,490,600 | 2/1996 | Bustos | 211/59.2 |

OTHER PUBLICATIONS

Brochure—"The Milk Moover®" gravity flow shelving systems, copyright 1987, b–o–f corporation, Lombard, IL.

Brochure—"Milk Moover®" gravity flow shelving systems, B–O–F Corporation, Lombard, IL.

Brochure—"the Milk Moover®", b–o–f corporation, Lombard, IL.

Brochure—Gravity Flow Shelving Systems, Milk Moover®, Nyla–Track II®, Nyla–Rol™, copyright 1990, B–O–F Corporation, Lombard, IL.

*Primary Examiner*—Alvin C. Chin-Shue
*Assistant Examiner*—Sarah L. Purol
*Attorney, Agent, or Firm*—McAndrews, Held & Malloy, Ltd.

[57] ABSTRACT

A gravity flow shelving system is adapted for displaying and storing merchandise in a variety of different arrangements. Each shelf on the flow shelving system comprises a bent wire frame and a shelf surface formed by a plurality of longitudinal wire tracks, allowing for uninterrupted sliding during gravity flow. A flexibly mountable backsplash spans the front of the shelf to shield price or advertising labels from potential leakage of the merchandise. Separators having U-shaped clasps affixed thereon are flexibly mountable to each shelf to form merchandise rows. Hooking members extend underneath each shelf to anchor the shelf to vertically adjustable mounting plates selectively positioned along the channeled uprights of the gravity flow shelving system.

10 Claims, 5 Drawing Sheets

16
18
19
22
24
38
40
42
44
46
47
48
X
4
5

GRAVITY FLOW SHELVING SYSTEM

BACKGROUND OF THE INVENTION

1. Field of Art

The present invention relates generally to container storage racks and more particularly to gravity flow shelving systems adapted for the display and storage of a variety of merchandise. The present invention features a versatile gravity flow shelving system having easily adjustable separators and easily adjustable shelves to adapt to a variety of merchandising arrangements.

2. Prior Art

Gravity flow shelving systems are known in the merchandising art. Prior art gravity flow racks generally include an assembly of vertically spaced racks angled downwardly and forwardly, providing more shelf space than flat shelving units. During gravity flow, substantial slidable contact is made between the bottom surface of the merchandise and the upper surface of the rack. To expedite the sliding movement, each rack typically features a low friction roller or track surface so that when a purchaser removes merchandise from the front of the rack, the remainder of the merchandise in the row easily slides forward to facilitate handling by the next purchaser. This provides a natural first in first out (FIFO) movement to ensure that earlier-dated items are sold first.

Merchandising of containers carrying fresh liquids such as milk products or fruit juices present known risks of leakage from their containers. Fresh liquids are primarily packaged in square paper-product containers coated with suitable plastics or paraffin, which frequently tear or rupture, causing the liquids to leak. Alternatively, the liquids are packaged in rectangular plastic containers, which are also prone to leakage through their capped openings. When liquids collect on the gravity flow racks, unsightly and unsanitary bacteria-breeding conditions are created. Accumulations of such liquids also leave sticky residues that adversely affect low friction sliding surfaces.

These problems were addressed in Doll U.S. Pat. No. 4,331,243, which discloses a gravity flow rack in which wire shelves are coated with an epoxy enamel. Triangular bent-wire divider-track members are mountable on each shelf, forming parallel merchandise channels or rows. Containers stocked in the rows are supported beneath by only two thin wire tracks, thereby requiring minimal surface contact between the bottoms of the containers and the rack surface, and thus substantially reducing the problems associated with the commercial handling of fresh liquids. However, the shelving and dividers of the Doll gravity flow rack are secured using wing nuts and bolts, making it relatively difficult to assemble or vary the configuration of the Doll gravity flow rack.

OBJECTS OF THE INVENTION

Because fresh liquids are low-margin high-volume merchandise, owners must reduce operating costs to increase profits. Labor costs can be decreased if less time is spent refacing and restocking merchandise. It is therefore an object of the present invention to provide a gravity flow rack that may be easily and quickly configured and cleaned, preferably without sacrificing durability, longevity, and price.

Another object of the invention is to provide a gravity flow rack in which the shelves are made from predominantly inexpensive wire or inexpensive plastics.

A further object is to provide a gravity flow rack in which advertising or pricing labels may be easily inserted to facilitate the merchandising of the fresh liquid containers.

Yet another object is to provide a gravity flow rack in which an easily mountable backsplash protects the advertising or pricing labels from potential leakage from the fresh liquid containers.

A still further object is to provide a gravity flow rack having component parts that are easy to assemble and adjustable to accommodate different types and sizes of containers.

Still another object is to provide a gravity flow rack that is relatively inexpensive to make.

A further object is to provide a gravity flow rack that is easy to disassemble and easy to clean.

Yet another object is to provide a gravity flow rack that will be useable in many existing installations for prior art racks.

A still further object of the invention is to provide a gravity flow rack that is attractive and decorative.

Another object is to provide shelving for a gravity flow rack that is lightweight yet durable and relatively strong.

An additional object is to provide a gravity flow rack in which the racked items automatically are maintained in the proper order and in which the front of each succeeding item automatically moves into place on the front face of the rack when a preceding item is removed from the rack.

These and other objects and advantages will become apparent as the specification proceeds.

SUMMARY OF THE INVENTION

The foregoing and other objects are achieved by the present invention of a gravity flow rack having a plurality of shelves supported on a structural frame. The structural frame comprises four channelled frame members held together by a plurality of cross braces. The shelves are anchored to the structural frame via hooks protruding from each shelf, which engage with adjustable mounting plates positioned along the frame members. Preferably, each mounting plate is secured to a channelled frame member by either (i) a bolt passing through a hole in the mounting plate and protruding into the channel, or (ii) a series of hooks extending from the plate into hook apertures in the frame member. A variety of shelving configurations may be achieved by changing the positions of the mounting plates along the frame members.

Preferably, the surface of each shelf has a plurality of spaced longitudinal tracks or wires that provide an uninterrupted surface for merchandise to slide forwardly due to gravity when the shelf is mounted on the structural frame. Preferably, transverse bars positioned underneath the longitudinal tracks provide additional support for each shelf without interrupting the plane of the longitudinal tracks. In addition, a label or price tag support may be provided at the front of each shelf to display pricing or advertising labels. This support may be shielded from any potential leakage from the containers by a backsplash, which may be flexibly mounted at a position behind the label support.

The shelves may preferably be adapted to receive at least one longitudinal separator, which can be adjustably mounted and horizontally spaced at desired positions to define a variety of different merchandise channels. Preferably, each end of each separator has an arcuate or U-shaped clasp secured thereon. To mount the separator to the shelf, one arcuate clasp can engage a transverse bar, and the separator may be flexibly mounted to allow the other arcuate clasp to engage with another transverse bar.

BRIEF DESCRIPTION OF THE DRAWINGS

The preferred embodiment is shown in the attached drawings in which.

In the following detailed description of the preferred embodiments, spacially orienting terms, such as "top," "above," etc, are used for ease of description. It is understood that this description does not by itself limit the scope of the invention to the orientation in space as thus stated in the description.

DETAILED DESCRIPTION OF THE PREFERRED EMBODIMENTS

Figure 10:
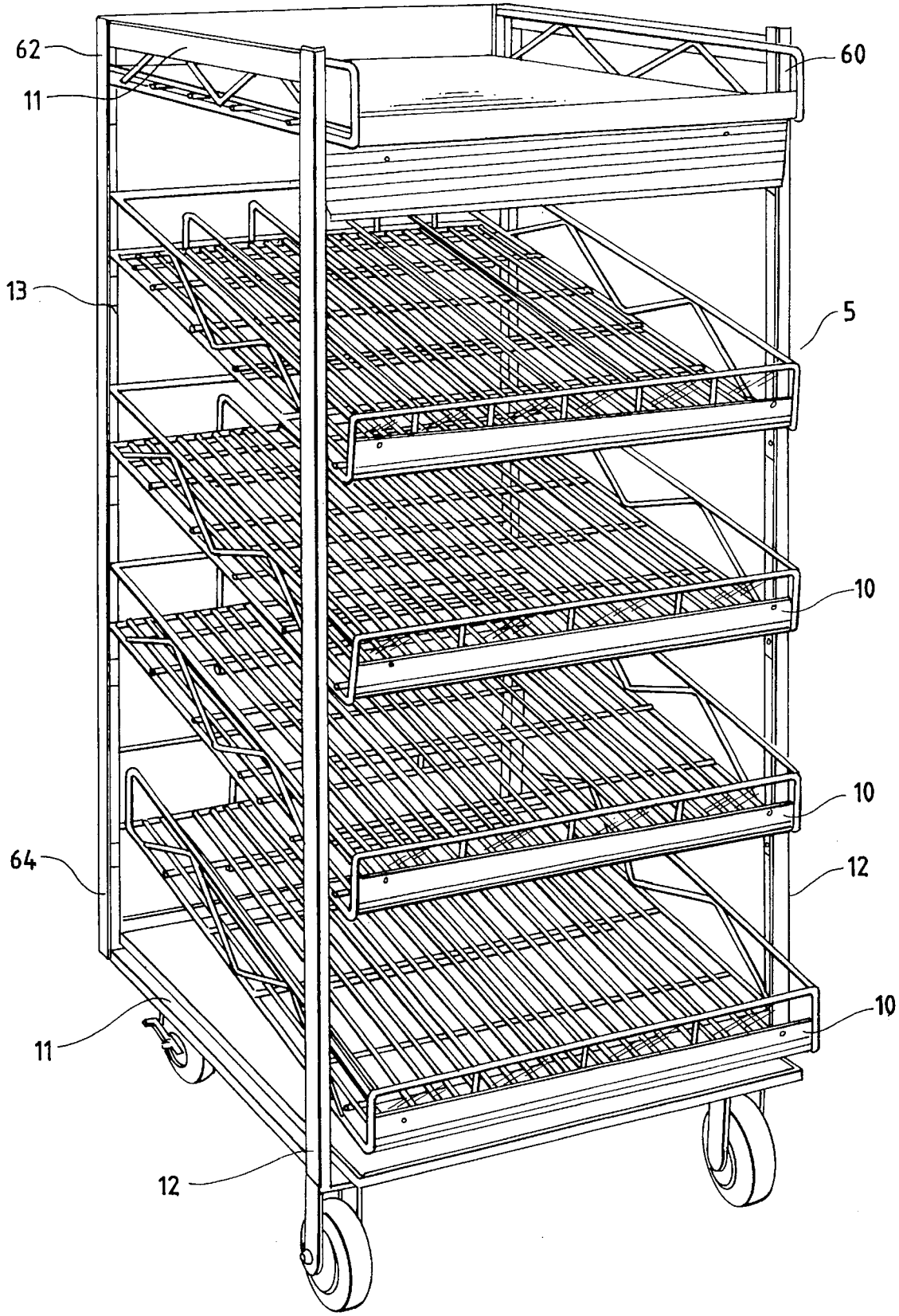
FIG. 10 is a front perspective view of the gravity flow rack system.

As seen in FIG. 10, the preferred gravity flow rack, generally 5, has a plurality of shelves 10 adjustably mounted on a structural frame 60 having four upright support members 12, 13 connected with rigid horizontally extending cross braces 11 at the top 62 and bottom 64 of the frame 60.

Figure 1:
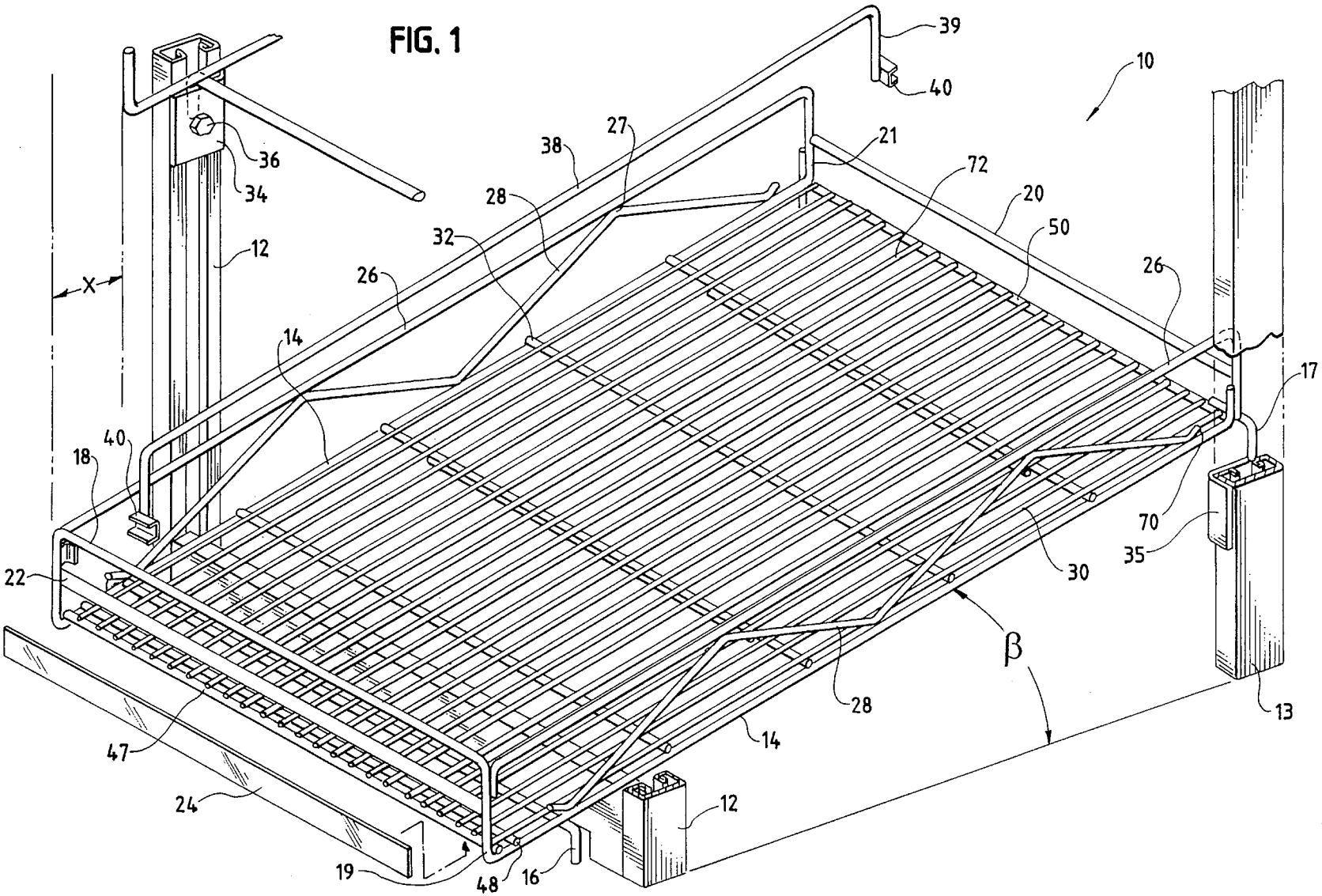
FIG. 1 is a partially exploded, perspective view of a shelf with a removable separator, with each shelf suspended on mounting plates or clips bolted into place on slotted upright supports.

As seen in FIG. 1, each shelf 10 has a generally rectangular shelf frame 70 including a pair of parallel, coplanar longitudinal arms 14 of equal length, a front cross bar 47 positioned on top of a first end of the longitudinal arms 14, and a back grip bar 50 positioned at the second end of the longitudinal arms 14. A plurality of coplanar longitudinal tracks 30 extending from the front cross bar 47 to the back grip bar 50 form the surface 72 of each shelf 10. The longitudinal tracks 30 are spaced between the longitudinal arms 14 and supported by a plurality of transverse, spaced, coplanar cross rods 32. The cross rods 32 extend underneath the longitudinal tracks and rest upon the longitudinal arms 14, such that the longitudinal tracks 30 provide an uninterrupted surface 72 for containers to slide forward from the back of the shelf 10 towards the front of the shelf 10 due to the constant pull of gravity.

A pair of front, coplanar upright legs 19 extend vertically from the first end of the pair of coplanar longitudinal arms 14, away from the plane of the longitudinal tracks 30. The front upright legs 19 preferably constitute extensions of the longitudinal arms 14 such that the legs 19 are bent in a direction perpendicular to both the shelf surface 72 and the longitudinal arms 14. The front upright legs 19 are joined together by a horizontally extending front retainer rod 18, preferably formed from the same rod member constituting the longitudinal arms 14 and the front upright legs 19. The front retainer rod 18 prevents containers (not shown) from sliding off of the shelf 10 during gravity flow from the back of the shelf 10 towards the front of the shelf 10.

A pair of back, coplanar upright legs 21 extend vertically from the second end of the pair of longitudinal arms 14, away from the plane of the longitudinal tracks 30. The longitudinal arms 14 are preferably welded to the back upright legs 21, which preferably constitute extensions of the back grip bar 50 such that the legs 21 are bent in a direction perpendicular to both the shelf surface 72 and the longitudinal arms 14. The back upright legs 21 are joined together by a horizontally extending back retainer rod 20 welded thereto. The back retainer rod 20 provides a back stop preventing containers from accidentally being pushed off the back of the shelf 10.

A pair of parallel, coplanar, longitudinally extending side rods 26 are welded to the front upright legs 19 and to the back upright legs 21 to retain the containers on the shelf 10. Support bars 28 are bendably laced between the side rods 26 and the longitudinal arms 14. As the support bars 28 are laced between the side rods 26 and the longitudinal arms 14, each junction 27 between the support bars 28 and the side rods 26 or longitudinal arms 14 is welded to provide additional structural support for the side rods 26. The length of each shelf 10 is defined by the front retainer rod 18 and the back retainer rod 20, while the width of each shelf 10 is defined by the pair of side rods 26.

Figure 6:
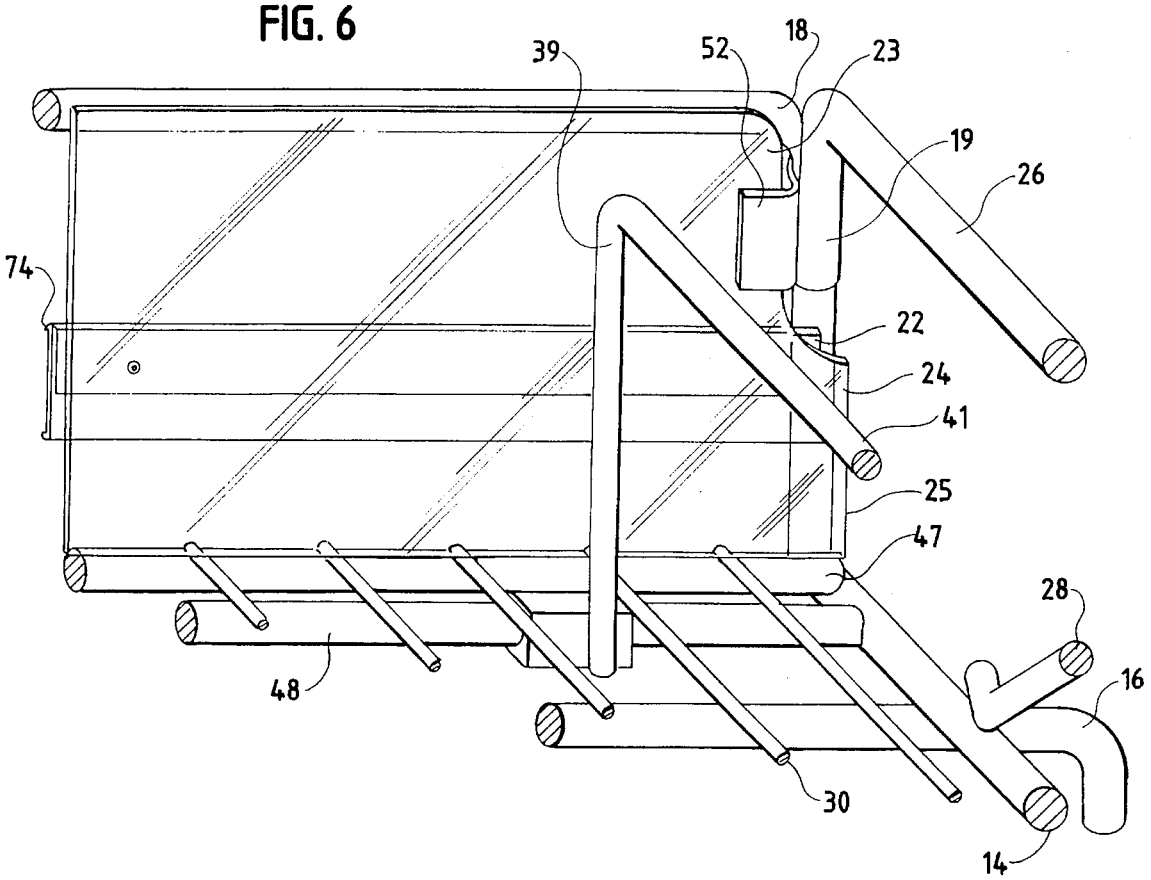
FIG. 6 is a fragmentary perspective view of the separator mounted on the shelf.

In the preferred embodiment depicted in FIGS. 1 and 6, the front of each shelf 10 features a label or price tag support 22 extending horizontally between, and secured to, the front upright legs 19, parallel to and above the front cross bar 47 and beneath the front retainer rod 18. The label support 22 comprises a flat, rectangular rigid member having opposing label-embracing ridges 74 directed lengthwise on the label support 22. Conventional rectangular-shaped pricing or advertising labels may be slidably engaged with the label support 22 and held in position by the ridges 74. The pricing or advertising labels are easily removable from the label support 22 by either slidable or flexible disengagement.

Preferably, the pricing or advertising labels are protected from potential leakage from the containers by a backsplash 24. The backsplash 24 has a substantially rectangular shape, the length of the rectangle substantially corresponding with the distance between the pair of longitudinal arms 14, and the height substantially corresponding with the height of the front upright legs 19. A pair of planar tabs 25 extend longitudinally from the rectangle, such that each side of the backsplash 24 appears to be stepped with an upper portion 23 and a lower tabbed portion 25.

The backsplash 24 is composed of a substantially rigid material, preferably Lucite, which can be flexibly mounted to a pair of backsplash grippers 52 welded to the rear of the front upright legs 19 behind the label support 22. All other components of the shelf 10 are made of a rigid material, such as steel, and are coated with hot nylon in a process that is well known in the art.

The backsplash grippers 52 engage the upper portions 23 of the sides of the backsplash, while the lower tabbed portions 25 extend beneath the backsplash grippers 52. The backsplash 24 extends across the full length of the front of the shelf 10, with the bottom of the backsplash 24 resting upon the longitudinal tracks 30 between the front cross bar 47 and the front grip bar 48. The backsplash 24 shields the front of the shelf 10 from potential leakage, and may be easily removed by hand for cleaning, without the need for special tools.

Figures 2, 3, 4, 5:
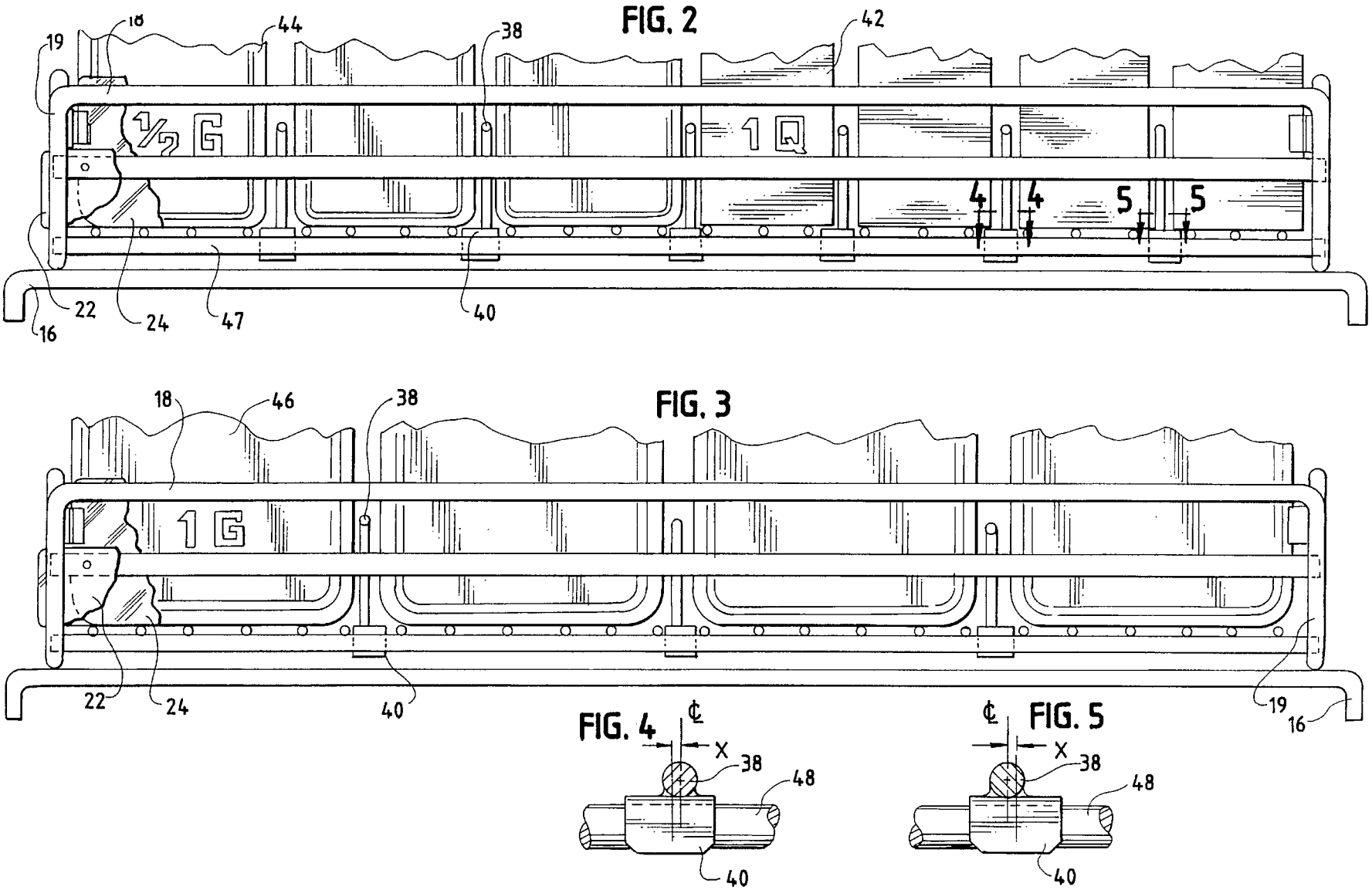
FIG. 2 is a frontal view of a shelf loaded with merchandise divided into seven rows by six separators.
FIG. 3 is a similar view using three separators.
FIG. 4 is a side view of a junction between the offset, U-shaped clasp and the separator.
FIG. 5 is another side view of a junction between the U-shaped clasp and the separator.

Each shelf 10 is adapted to receive multiple, removable, and parallel longitudinal separators, e.g., 38. As shown in FIGS. 2 and 3, the separators 38 are adjustably mounted and horizontally spaced at desired positions on the shelf 10 to provide a variety of different storage rows to accommodate, for example, quart 42, half gallon 44, or gallon-sized containers 46. Each separator 38 comprises a substantially rigid longitudinal wire 41 having a pair of upright wire separator legs 39 forming 90 degree angles at each end of the longitudinal wire 41.

An arcuate, and preferably U-shaped, clasps 40 is welded to the end of each upright separator leg 39, as shown in FIGS. 4 and 5. Each U-shaped clasp 40 has a diametral width across the width of U-shape and an axial width along the axis of the U-shape within the clasp 40. Preferably, the U-shaped clasp 40 is mounted on the separator leg 39 so that the axial center of the clasp 40 is offset with respect to the separator leg 39. The clasp is also mounted so that the body of the clasp 40 abuts the separator leg 39 while legs on the clasp 40 forming the U-shape extend outwardly away from the separator leg 39. The U-shaped clasp 40 abuts and clamps the outer periphery of the front grip bar 48 or the back grip bar 50.

To mount the separator 38 to the shelf 10, the U-shaped clasp 40 of the front separator leg 39 is mounted at the desired position to the front grip bar 48, and the longitudinal wire 41 is flexed so that the U-shaped clasp 40 on the back separator leg 39 may be mounted to the back grip bar 50. Alternatively, of course, the separator 38 may be mounted from the back to the front, using the opposite steps. In either event, the longitudinal wire 41 thus urges the U-shaped clasps 40 on the legs 39 to securely grip the outer periphery of the grip bars 50. The offset mounting of the clasp 40 allows for differing spacings between adjacent separators 38 by 180 degree rotation of one or more the separators and re-mounting of each rotated separator on the shelf 10.

A pair of hooked cross rods 16, 17 extend transversely from the underside of the first and second ends of the pair of longitudinal arms 14, beneath the surface of the shelf 72. Preferably, each hooked cross rod 16, 17 consists of a substantially straight wire bent at each end at angles substantially perpendicular to the shelf surface 72. The front hooked cross rod 16 extends laterally across the first ends of the pair of longitudinal arms 14, and is rearwardly spaced a distance of X from the front grip bar 48. The hooks of the front hooked cross rod 16 extend perpendicularly from the plane of the longitudinal tracks 30 in the opposite direction of the front upright legs 19. The back hooked cross rod 17 extends laterally across the second ends of the longitudinal arms 14 and is forwardly spaced from the back grip bar 50 toward the front grip bar 48. The hooks of the back hooked cross rod 17 extend perpendicularly from the plane of the longitudinal tracks 30 in the opposite direction of the back upright legs 21.

Figure 7:
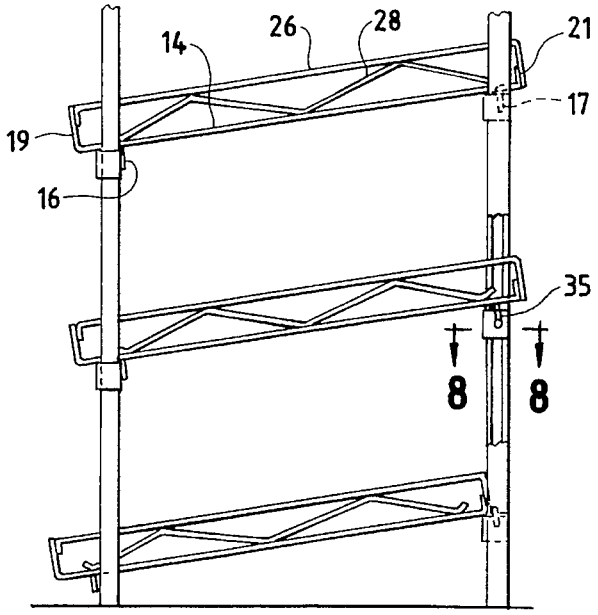
FIG. 7 is a side view of a gravity flow storage system.
Figure 8:
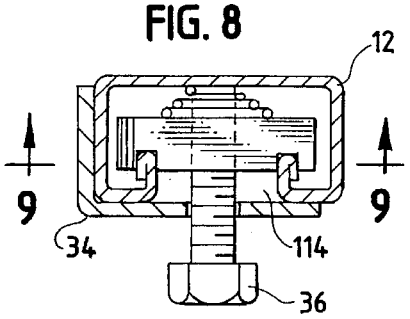
FIG. 8 is a cross-sectional view looking down from above the junction of a support member and a structural member.
Figure 9:
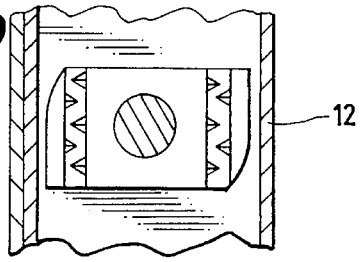
FIG. 9 is a cross-sectional view of the support member fastened to a structural member.

As shown in FIG. 7, the hooked cross rods 16, 17 slidably penetrate the upright support member 12, 13 in order to mount the shelf 10 to the frame 60 of the gravity flow rack 5. Preferably, each upright support member 12, 13 defines a channel extending longitudinally throughout the length of the upright support member 12, 13. As shown in the preferred embodiment of FIGS. 8 and 9, each upright support member 12, 13 has at least one mounting plate 34, 35 secured thereon. The mounting plates 34, 35 are substantially L-shaped, having a channel surface and a perpendicular flush surface. In one embodiment, the channel surface of the mounting plate 34, 35 is characterized by a threaded hole formed therein, which corresponds with the channel defined by the upright support member. The L-shaped mounting plate 34, 35 may be adjustably connected to the upright support member 12, 13 by means of a bolt 36, which threads the hole in the L-shaped mounting plate 34, 35 to abut the interior of the upright support member 12, 13. The flush surface of the mounting plate 34, 35 rests against a side of the upright support member 12, 13.

Figure 11:
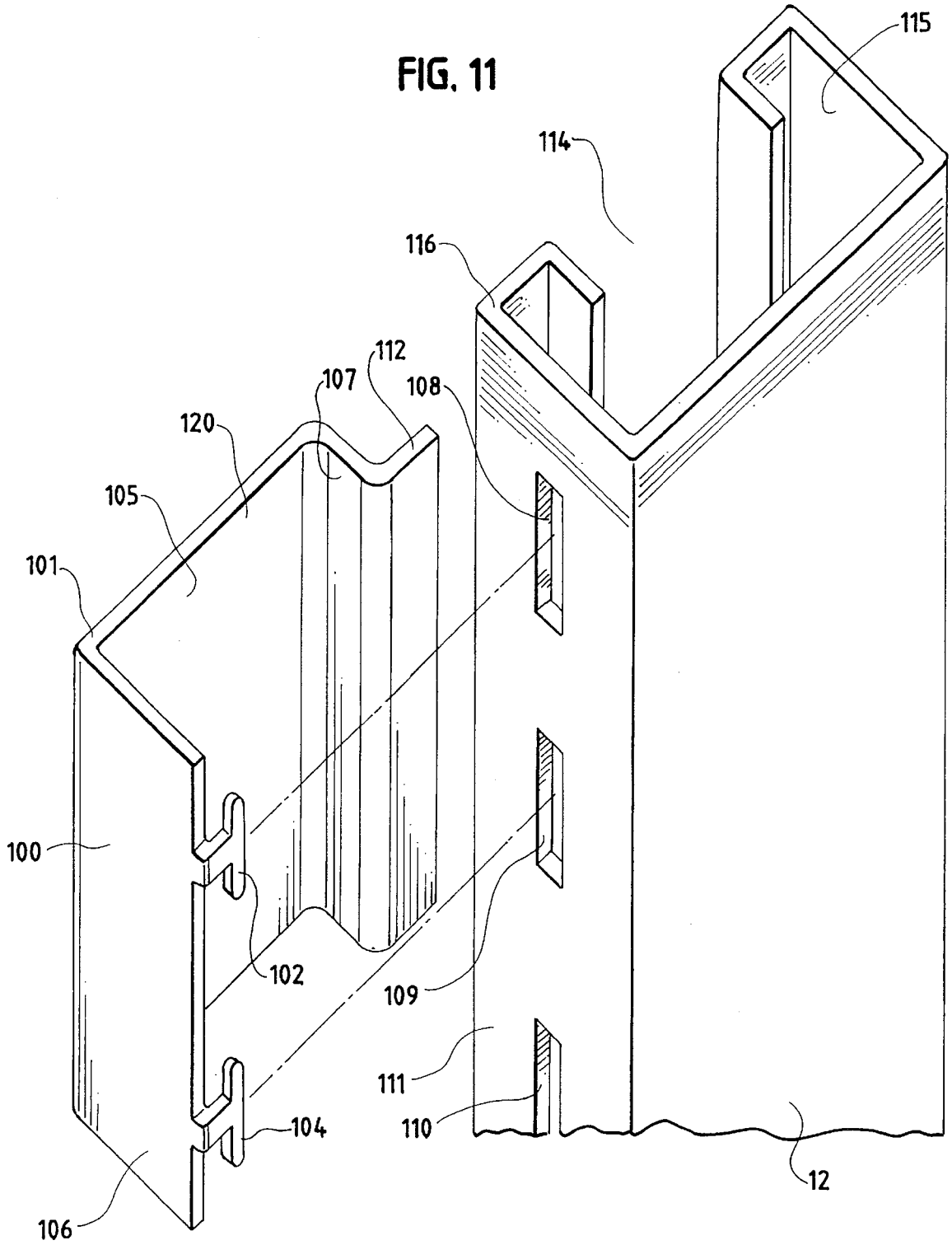
FIG. 11 is a perspective view of an alternative clip for hanging shelving on the upright supports.

Alternatively, as shown in FIG. 11, the mounting plate 100 may consist of a generally U-shaped body 101. The body 101 thus has a central shelf mounting planar section 105 and two opposing parallel legs 106, 107 extending vertically and perpendicularly from the mounting section 105. Two T-shaped mounting hooks 102, 104 extend perpendicularly from an outer leg 106 on the body 101 parallel to and in the direction of the opposing second leg 107 of the plate 100. The upright support 12 has a series of hook apertures 108, 109, 110 along its axial length on a side forming a first U-shaped support leg 111 of the support 12. The hooks 102, 104 can thus penetrate and slide downward within any two adjacent apertures 108, 109, and the first leg 106 thus abuts a first U-shaped support leg 111 surrounding and forming one side of a U-shaped vertical channel 114 in the upright support 12. The second leg 107 has a retaining arm or lip 112 extending vertically and perpendicularly from the second leg 107 and away from the opposing first leg 106. The second leg 107 thus penetrates the vertical channel 114 in the upright support 12 so that the lip 112 securely abuts the second U-shaped support leg 115 forming a second side of the U-shaped channel 114.

The second leg 107, lip 112, first leg 106, and hooks 102, 104 thus all securely abut various portions of the upright 12 to cooperatively secure the plate 100 in place on the upright 12 with the second leg 106 extending generally horizontally across the channel 114 in the upright support. This orientation, and support for a shelf, are accomplished without need for fasteners as in the FIGS. 8 and 9 embodiment and provide for very rapid, inexpensive, and secure location, adjustment, and readjustment of the location of the plate 100 on the upright 12.

Referring back to FIGS. 1, 8, and 9, the mounting plates 35 are mounted to the rear-most upright support members 13 at substantially equal vertical positions with respect to the ground (not shown). The L-shaped mounting plates 34 are also mounted to the front-most upright support members 12 at substantially equal vertical positions with respect to the ground, but at positions slightly lower than the positions of the L-shaped mounting plates 35 on the rear-most upright support members 13, such that when the shelf 10 is mounted, a gravity feed angle B is formed between the plane of the shelf 10 and the plane of the ground.

The shelf 10 is anchored to the structural frame of the gravity flow rack 5 by placing the hooked ends of the front hooked cross rod 16 in the channel 114 of the front-most upright support members 12 such that the front hooked cross rod 16 rests on the portion of the L-shaped mounting plates 34 horizontally extending across the channel 114. Similarly, the hooked ends of the back hooked cross rod 17 are placed in the channels formed by the rear-most upright support members 13 such that the back hooked cross rod 17 rests on the L-shaped mounting plates 35. The shelf can easily be removed for cleaning by lifting the hooks out of the channels. In this configuration, the forward end of the shelf is angled downwardly from the rear end of the shelf, such that gravity will urge the containers on the shelf to slide or flow toward the forward end of the shelf. The angle between the plane of the shelf and the plane of the ground can be easily adjusted as desired by varying the positions of the mounting plates 34, 35 on the upright support members 13, 14.

The present invention thus provides a durable gravity flow rack having easily adjustable shelves which may be constructed from relatively inexpensive materials. The structural frame of the present invention allows the user to position shelves at a variety of different heights and at a variety of different angles. The present invention also provides various merchandising options such as separators which may be easily configured to form a variety of merchandising channels, a label support to hold pricing or advertising indicia, and a backsplash to protect the label support from any potential leakage from the merchandise. The present invention also provide particularly advantageous and inexpensive quick adjust mounting plates for mounting the shelves on the rack.

In the foregoing, the applicant has described the preferred embodiment of the present invention. The scope of the invention, however, is to be determined by reference to the following claims.

What is claimed is:

1. A shelf for storing and displaying containers, said shelf comprising:

a wire frame having a plurality of cross bars within the frame, a plurality of substantially planar longitudinal track bars mounted above the cross bars, and a pair of front legs and a pair of back legs protruding above the plane of said longitudinal tracks, wherein each front leg includes a backsplash gripper attached thereto;

a front retaining bar and a label support holder each extending between said pair of front legs, said label support holder being adapted for slidable engagement of labels therewith;

a rear retaining bar extending between said pair of back legs;

a pair of side retaining bars, each side retaining bar extending between a front leg and a back leg; and a flexibly mountable backsplash positioned between said backsplash grippers and said label support holder, said backsplash extending substantially across said width of said shelf.

2. The shelf of claim 1 wherein said shelf is divided into separate channels by at least one separator, each separator comprising:

a wire extension member extending above the plane of said longitudinal tracks for substantially the length of said longitudinal tracks, a first leg connected to said wire extension member at an angle substantially perpendicular to said wire extension member, said first leg having a first arcuate clasp attached thereto; and a second leg connected to said wire extension member at an angle substantially perpendicular to said wire extension member, said second leg having a second arcuate clasp attached thereto;

wherein said separator is flexibly biased between two cross bars by coupling said first arcuate clasp to a first cross bar and by coupling said second arcuate clasp to a second cross bar.

3. The shelf described in claim 2, wherein each said first and second arcuate clasps is formed in a U-shape around a clasp axis and wherein said first and second arcuate clasps has an axial width.

4. The shelf described in claim 3, wherein said first arcuate clasp is mounted to said first leg of said separator such that the axial center of said first arcuate clasp is offset with respect to said first leg of said separator, and wherein said second arcuate claps is mounted to said second leg of said separator such that the axial center of said second arcuate clasp is offset with respect to said second leg of said separator.

5. The shelf described in claim 1, wherein said backsplash includes first and second tabbed portions extending beyond said backsplash grippers to help secure said backsplash to said shelf.

6. A gravity flow rack comprising:

a structural frame formed by a plurality of upright support members rigidly connected by cross braces, said upright support members each defining a longitudinal channel along its axial length;

at least one L-shaped mounting plate adjustably fastened to each of said upright support members, each L-shaped mounting plate defining a channel surface and a substantially perpendicular flush surface, said channel surface having a threaded hole formed therein, said threaded hole corresponding with said longitudinal channel of said upright support member, wherein said L-shaped mounting plate is adjustably connected to one of said upright support members by threading a bolt through said threaded hole such that said bolt abuts the interior of said upright support member and said flush surface rests against a side of said upright support member;

at least one shelf, said shelf comprising a wire frame, a plurality of longitudinal tracks extending for the length of said shelf and fixedly attached to said wire frame, said plurality of longitudinal tracks forming a low friction shelf surface, a plurality of cross bars extending underneath said low friction shelf surface, a pair of front legs and a pair of rear legs protruding above said low friction shelf surface, a front retaining bar extending between said pair of front legs, a rear retaining bar extending between said pair of rear legs, and a pair of side retaining bars, each side retaining bar extending between a front leg and a rear leg;

a pair of front hooks and a pair of back hooks protruding at an angle substantially perpendicular to the plane of the low friction shelf surface, said front and back hooks cooperating with said L-shaped mounting plates such that each said hook is positioned within a channel of an upright support member and each said hook rests on an L-shaped mounting plate such that said shelf is secured to said structural frame.

7. The gravity flow rack of claim 6, wherein first and second mounting plates are fastened to said upright support members at substantially equal vertical heights and third and fourth mounting plates are fastened to said upright support members at substantially equal vertical heights slightly higher than the said vertical heights of said first and second mounting plates.

8. A gravity flow rack comprising:

a structural frame formed by at least four upright support members rigidly connected by cross braces, each said upright support member including a longitudinal channel and a series of hook apertures along its axial length;

at least one generally U-shaped mounting plate adjustably fastened to each of said upright support members, each mounting plate defining a central shelf mounting panel, an outer panel, and an inner panel, said outer panel having at least one T-shaped mounting hook extending perpendicularly therefrom such that said T-shaped mounting hook slideably penetrates a hook aperture in said upright support member to secure said mounting plate to said upright support member;

a pair of front hooks and a pair of back hooks protruding at an angle substantially perpendicular to the plane of the low friction shelf surface, said front and back hooks cooperating with said L-shaped mounting plates such that each said hook is positioned within a channel of an upright support member and each said hook rests on an L-shaped mounting plate such that said shelf is secured to said structural frame.

9. The gravity flow rack of claim 8, wherein said inner panel of said U-shaped mounting plate has a retaining arm extending perpendicularly therefrom, said retaining arm and said inner panel penetrating said longitudinal channel and abutting said upright support member to secure said U-shaped mounting plate to said upright support member.

10. A shelf for storing and displaying containers, said shelf comprising:

a generally rectangular wire frame defining a shelf width and a shelf length, said wire frame having a plurality of spaced cross bars extending across said shelf width, a plurality of substantially planar longitudinal track bars mounted above said cross bars, said longitudinal track bars extending across said shelf length, and a pair of front legs and a pair of back legs protruding substantially perpendicular to the plane of said longitudinal tracks, each leg being positioned at a corner of said wire frame;

a front retaining bar extending between said pair of front legs above the plane of said longitudinal tracks;

a rear retaining bar extending between said pair of back legs above the plane of said longitudinal tracks;

a pair of side retaining bars, each side retaining bar extending between a front leg and a back leg above the plane of said longitudinal tracks; and at least one adjustable separator to divide said shelf into separate longitudinal channels, each separator having a wire extension member extending above the plane of said longitudinal tracks for substantially the length of said longitudinal tracks, a first leg connected to said wire extension member at an angle substantially perpendicular to said wire extension member, said first leg having a first arcuate clasp attached thereto, said first arcuate clasp being adapted to grip the outer periphery of a first cross bar; and a second leg connected to said wire extension member at an angle substantially perpendicular to said wire extension member, said second leg having a second arcuate clasp attached thereto, said second arcuate claps being adapted to grip the outer periphery of a second cross bar;

wherein said separator is flexibly biased between said first and second cross bars by coupling said first arcuate clasp to said first cross bar and by coupling said second arcuate clasp to said second cross bar.

* * * * *